United States Patent [19]

Corgnet

[11] 4,048,944

[45] Sept. 20, 1977

[54] INTERCONNECTION OF A FLOATING STRUCTURE AND A SUBMERGED ANCHOR STATION

[75] Inventor: Jean Louis Corgnet, Boulogne, France

[73] Assignee: Compagnie Francaise des Petroles, Paris, France

[21] Appl. No.: 660,589

[22] Filed: Feb. 23, 1976

[30] Foreign Application Priority Data

Feb. 21, 1975 France ..... 75.05418

[51] Int. Cl.[2] ..... B63B 21/50

[52] U.S. Cl. ..... 114/293; 9/8 P; 61/95; 114/296

[58] Field of Search ..... 114/230, 206 L, .5 D, 114/.5 T, 293, 294, 296, 264, 266, 267; 9/8 P; 61/94, 95, 69 R

[56] References Cited

U.S. PATENT DOCUMENTS

| | | | |
|---|---|---|---|
| 3,264,662 | 8/1966 | Young | 9/8 P |
| 3,522,709 | 8/1970 | Vilain | 61/95 |
| 3,708,985 | 1/1973 | Pogonowski | 114/264 X |
| 3,735,597 | 5/1973 | Guy | 61/95 |
| 3,785,313 | 1/1974 | Rosenberg | 114/.5 T |
| 3,870,010 | 3/1975 | Wright | 114/267 X |

*Primary Examiner*—Trygve M. Blix
*Assistant Examiner*—Sherman D. Basinger
*Attorney, Agent, or Firm*—Sughrue, Rothwell, Mion, Zinn, and Macpeak

[57] ABSTRACT

A connecting structure for interconnecting a floating structure and a submerged anchor station is disclosed. This structure comprises an anchor cap which is adapted to be fixed to the anchor station and an arm which is pivotably connected to the floating structure. The pivotal connection to the anchor cap is by a ball and socket joint with the socket extending around more than half the lateral area of the ball. The cap is adapted to be pressed down to the enclosure by hydrostatic pressure.

14 Claims, 3 Drawing Figures

INTERCONNECTION OF A FLOATING STRUCTURE AND A SUBMERGED ANCHOR STATION

The present invention is concerned with the connection of a floating structure to an underwater anchor station or an underwater installation, and is particularly but not exclusively concerned with the connection of a floating platform with a high storage capacity to a manifold for collecting petroleum products.

The applicant's U.S. Pat. No. 3,961,490 proposes the use of connecting means in the form of an anchor cap carried at the end of an arm connected to the floating structure, the arm being able to assume a variable inclination relative to the anchor cap by turning about a horizontal axis which provides the connection between the arm and the cap. The floating structure is able to turn about the vertical axis of the cap, which is movably attached to the upper part of the wall of an enclosure containing the manifold, to which is connected a suitable conduit supported by the arm.

Although such a connecting means is adequate in normal conditions, it is liable to be abnormally strained by severe weather conditions or as a result of the combined action of the wind and drift ice floes.

According to the present invention, there is provided means for interconnecting a floating structure and a submerged anchor station including an enclosure, said means comprising an anchor cap adapted to be fixed to the anchor station and an arm adapted to be pivotally connected to the floating structure and which is pivotally connected to said anchor cap by a ball-and-socket joint, wherein, in use, the cap is adapted to be pressed down on the enclosure by hydrostatic pressure.

By use of the present invention, for all weather conditions and whatever the movements of the floating structure, connecting means can be provided in which all abnormal strains are avoided which would have been imposed by the arm linking the floating structure to the cap held on the enclosure, especially the strains due to torsional forces. Because of this such means can be used even if the anchorage is a deep one. For greater depths it is also possible to use an arm having two parts, one of which is vertical and the other horizontal, the parts of the arm being coupled together by a pivotal connection with a horizontal axis of rotation, without risking abnormal torsional loads.

Moreover, since the cap is not movable on its seat, it may have a greater support surface than the known connecting means, and so further increase the reliability of the system.

The connecting means may include a fluid conduit provided in a passage in the ball and formed in two parts which parts are connected together by a ball-and-socket joint concentric with the ball-and-socket joint connecting said arm to said cap. With this feature, besides the advantage of being able to pass petroleum products through rigid metal pipes which do not suffer any large stresses, space can be made available between the walls of the passage in the ball of the arm and the outside walls of the ball-and-socket joint of the fluid conduit, and can be big enough to give access to the interior of the enclosure for testing various devices which may be connected to the fluid conduit. As the cap is not movable on the anchor station, there is no disadvantage in weighing it down with all kinds of safety devices, safety valves, for example.

The connecting means may comprise stops for limiting tilting of the ball-and-socket joint during the descent of the arm, and means in the lower part of the cap for locking the cap to the anchor station. The cap and anchor station may be provided with mating frustoconical surfaces, an annular seal forming a water-tight seal between the surfaces.

Such frustoconical bearing surfaces between the cap and anchor structure are particularly well suited to stand up to the high loads to which the cap may be subjected when fixed, because the cap can bear on its seat over a relatively large area without risk of causing deterioration of seals between the bearing surfaces.

The stops may have frustoconical surfaces, the upper surface of the cap and the facing lower surface of the lower end of the arm being frustoconical to allow the ball-and-socket joint to rotate about a horizontal axis without these surfaces touching, once the cap is anchored.

To eliminate all abnormal stresses on the coupling between the floating structure and the arm carrying in the event of yawing of the floating structure, the coupling may comprise a ball-and-socket joint. The arm and joint may include passages connected. It then becomes possible to keep the platform at its anchor point without difficulty and without the need to use a horizontal rotary joint required only to prevent transmission of rolling movements of the platform. The ball-and-socket joint eliminates all stresses due to pitching, rolling and yawing of the floating structure and considerably simplifies the connection of the arm to the floating structure.

The invention will be more fully understood from the following description of an embodiment thereof, given by way of example only, with reference to the accompanying drawing.

Figure 1:
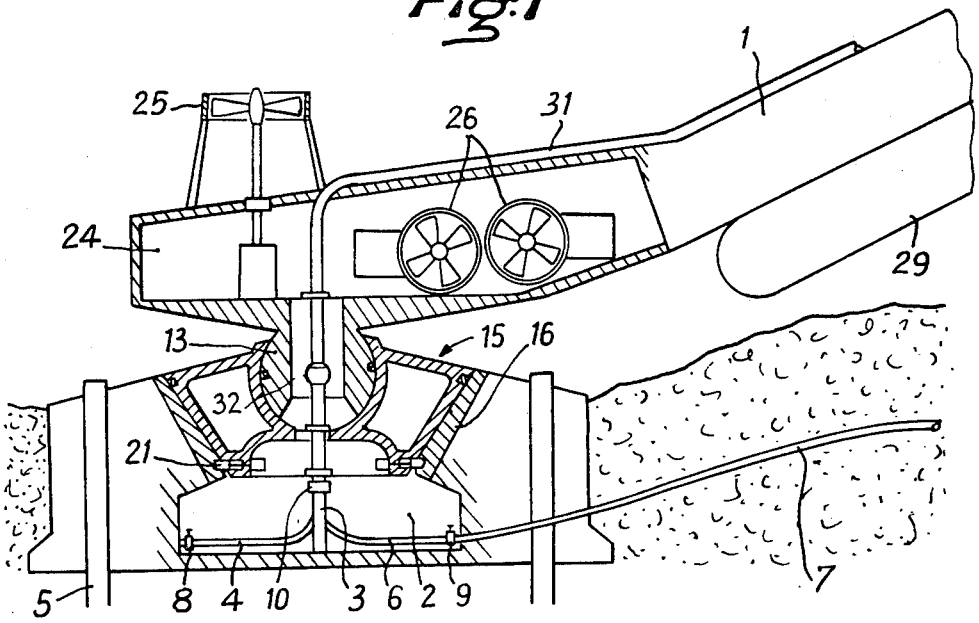
FIG. 1 is a partly cut away and partly sectioned diagrammatic lower view of the connecting end portion of an embodiment according to the invention.

In the embodiment shown, an underwater station, to which a floating platform is anchored by arm 1, comprises a watertight enclosure 2 which may contain a manifold 3 for collecting petroleum products. In order to show a general application of the connecting means, there is shown at 4 a fluid conduit from a well shown schematically at 5, and at 6 an intermediate conduit connected to a fluid conduit 7. Valves 8 and 9 allow control of access to the manifold 3. The manifold 3 may end in a valve 10 connected to a connector 11 is a pipe 12 which may be part of means for connecting the enclosure 2 to the floating platform.

The lower end of the arm 1 comprises a ball 13 slidable within a socket 14 forming part of an anchor cap 15. For any tilt of the ball 13 in its socket 14, the frustoconical side surface 17 of the cap 15 is applied to frustoconical surface 16 around the opening of the enclosure 2. At least one seal 18 provides a watertight seal at the interface 16–17. Bolts 19, under the control of cylinders 20, for example, enable the anchor cap 15 to be held in position before it is held down by hydrostatic pressure on emptying the water from the enclosure 2, which is then filled with air at atmospheric pressure. The bolts 19 engage in recesses 21, which are preferably provided by an annular groove in the lower portion of the frustoconical surface 16. To free the arm 1 from the anchorage, it is sufficient to withdraw the bolts 19 into recesses 22 in the cap 15, after filling the enclosure 2 with water and equalizing the pressure by means of circuits of any suitable type (not shown).

When access to the closed enclosure or to the normally open cavity 2 is required, a passage 23 is provided in the ball 13, leading from a chamber 24 in the lower end of arm 1 to a hatch 27 in the lower wall 28 of the anchor cap. The chamber 24 may contain the drive controls of propulsion units 25 and 26 for moving the lower end of the arm 1 respectively vertically and horizontally, as well as controls for ballast 29 for increasing or decreasing the weight of the arm. A corridor (not shown) in arm 1 connects the chamber 24 to the floating platform. When the hatch 27 is open to provide communication between the chamber 24 and the enclosure 2, a watertight seal is provided by at least one seal 30*a* in a groove in the ball 13 and engaging the socket 14 and/or a seal 30*b* in a groove in the socket 14 and over which the ball slides.

Each of seals 30*a* and 30*b* may in practice consist of several parallel seals, a film of oil being provided between the seals 30*a* and 30*b* to act as a lubricating film and to counterbalance the hydrostatic pressure. The seal 30*a* is preferably mounted on the lower part of the ball 13 and the seal 30*b* on the upperpart of the socket 14 in contact with the ball.

The passage 23 contains centrally the fluid conduit 31 connected to the anchor cap pipe 12 by a ball-and-socket joint 32 which is concentric with the ball-and-socket joint 13.

The method of attaching the connecting means which have just been described consists in controlling the slow descent of the lower end of the arm 1 until the frustoconical surface 17 of the cap 15 slides into the frustoconical surface 16 of the enclosure 2, and then locking the cap 15 to the enclosure by operation of the cylinders 20 at the end of the descent movement of the cap 15. After emptying the underwater enclosure of water and filling it with air at atmospheric pressure, the hatch 27 can be opened.

In a modification, the enclosure 2 can be kept at atmospheric pressure by means of a watertight bulkhead provided with a hatch at a level between the connections 10 and 11, that part of the cap between the bulkhead of the enclosure 2 and the wall 28 of the cap forming an airlock.

To provide an anchorage which is able to stand up to considerable loads, the socket 14 is made so as to engage more than half the sphere of the ball 13, and the lower part of the arm 1 and the upper part of the cap 15 are provided with the frustoconical surfaces whose respective generatrices diverge in a direction away from the ball-and-socket joint to provide enough clearance between the cap 15 and the arm 1 so that these surfaces do not touch each other during anchoring.

Stops such as 35 with frustoconical surfaces may be placed on the cap 15 or on the arm 1 to limit relative movement of the arm 1 and cap 15 before the latter is put in position over the enclosure 2.

Figure 2:
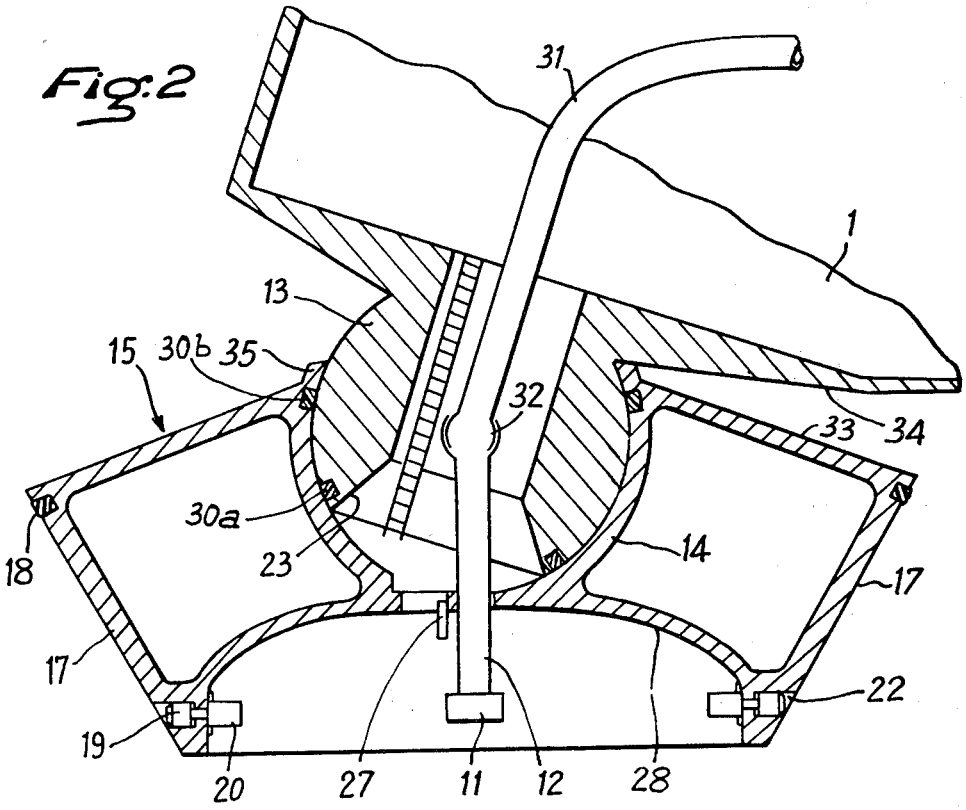
FIG. 2 is a diagrammatic view of part of the connecting means shown in FIG. 1 after tilting of the arm.
Figure 3:
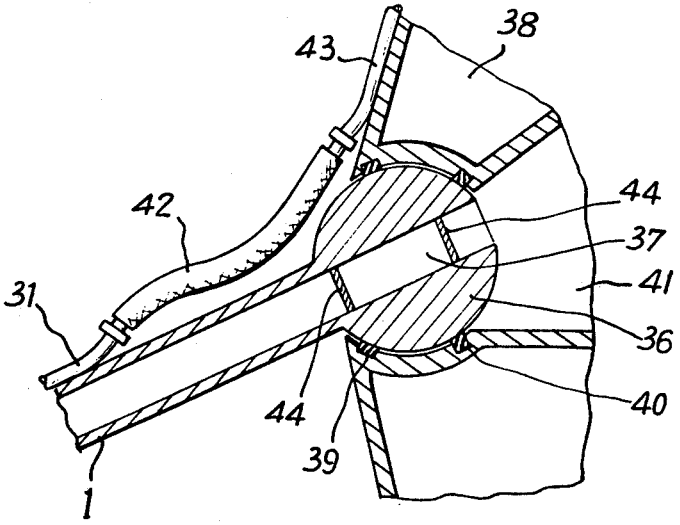
FIG. 3 is a cut away sectional diagrammatic view of the upper end of the connecting means of FIG. 1.

The upper end of the arm 1, shown in FIG. 3, comprises the ball 36 of a ball-and-socket joint, the ball 36 containing an airlock 37 defined by hatches 44, which enable the passage leading to the enclosure 2 via the hatch 27 of the cap 15 (FIG. 2) to be put in communication with the platform, of which only socket 38 enclosing the ball 36 has been shown. Socket 38 contains two seals 39 and 40 separating chamber 41 from the sea. Oil under pressure between the seals 39 and 40 provides a lubricating film ensuring free rolling movement of the ball 36. Thus, however the platform may move, no unwanted stresses are transferred to the anchor arm 1 by the structure 38, whether such movement is due to rolling, yawing or pitching.

Although it is always possible to use a ball-and-socket joint concentric with the ball-and-socket joint 36, 38 for the passage of the fluid conduit from the arm 1 to the platform, is used at the lower end of the arm (FIG. 2), it is also possible to terminate the conduit 31 outside the upper end of the arm 1 and to connect it by means of a flexible tube 42 to a conduit 43 attached to the structure 38, as shown in FIG. 3. Such a connection can be used without disadvantage since the movement of the ball-and-socket joint 36 relative to the platform is small, except in the case of rolling movement, being a few degrees for rolling and less for yawing.

There is thus provided connecting means which can provide a reliable anchorage for a floating structure while at the same time being controllable to quickly release the platform, and which allows the platform to rotate freely around the anchor structure under the effects of wind and tide.

The connecting means are reliable and particularly well suited to deep anchorages of large platforms which are subjected to particularly severe weather conditions.

What is claimed is:

1. Apparatus for interconnecting a floating structure and a submerged anchor station including an enclosure, said apparatus comprising an anchor cap adapted to be fixed to the anchor station and pressed down to the enclosure by hydrostatic pressure, an arm adapted to be pivotally connected to the floating structure, and a ball-and-socket joint pivotally coupling said arm to said anchor cap, said socket engaging more than one half of the surface of said ball to form a rigid pivotal coupling.

2. Connecting means as claimed in claim 1, in which at least one seal is provided for sealing between the ball of said ball-and-socket joint and its socket to seal said enclosure from the external environment.

3. Connecting means as claimed in claim 2, in which a second seal is provided between said ball and said socket of said ball-and-socket joint, said first and second seals being located at the lower end of said ball and the upper end of said socket respectively, and a film of oil under pressure extends between said seals.

4. Connecting means as claimed in claim 1, in which said ball of said ball-and-socket joint is provided with a passage communicating at one end with a chamber in said arm.

5. Connecting means as claimed in claim 4, in which the other end of said passage is closed, the closure being provided with a watertight hatch.

6. Apparatus for interconnecting a floating structure and a submerged anchor station including an enclosure, said apparatus comprising, an anchor cap adapted to be fixed to the anchor station and an arm adapted to be pivotally connected to the floating structure and which is pivotally connected to said anchor cap by a ball-and-socket joint, a fluid conduit formed in two parts which are connected together by a ball-and-socket joint concentric with the ball-and-socket joint connecting said arm to said anchor station; wherein, in use, the cap is adapted to be pressed down on to the enclosure by hydrostatic pressure.

7. Apparatus for interconnecting a floating structure and a submerged anchor station including an enclosure, said apparatus comprising, an anchor cap adapted to be fixed to the anchor station and pressed down to the enclosure by hydrostatic pressure, and an arm adapted to be pivotally connected to the floating structure and which is pivotally connected to said anchor cap by a ball-and-socket joint, said cap having a frustoconical surface for engagement with a frustoconical surface on the anchor station, said frustoconical surface of the anchor station forming a passage leading to the enclosure and at least one annular seal provided for sealing between said frustoconical surfaces to seal said enclosure from the external environment.

8. Apparatus for interconnecting a floating structure and a submerged anchor station including an enclosure, said apparatus comprising, an anchor cap adapted to be fixed to the anchor station and an arm adapted to be pivotally connected to the floating structure and which is pivotally connected to said anchor cap by a ball-and-socket joint, said ball of said ball-and-socket joint provided with a passage communicating at one end with a chamber in said arm, means located in said chamber in said arm for controlling and monitoring the speed of horizontal and vertical movement of said arm, and at least one stop having a frustoconical surface for limiting tilting of said ball-and-socket joint during descent of said arm towards its anchored position; wherein, in use, the cap is adapted to be pressed down on to the enclosure by hydrostatic pressure.

9. Apparatus for interconnecting a floating structure and a submerged anchor station including an enclosure, said apparatus comprising, an anchor cap adapted to be fixed to the anchor station and pressed down to the enclosure by hydrostatic pressure, and an arm adapted to be pivotally connected to the floating structure and which is pivotally connected to said anchor cap by a ball-and-socket joint, wherein, a facing upper surface of said cap and a lower surface of said arm are frustoconical with the respective generatrices of said surfaces diverging in the direction away from said ball-and-socket joint.

10. Apparatus for interconnecting a floating structure and a submerged anchor station including an enclosure, said apparatus comprising, an anchor cap adapted to be fixed to the anchor station and an arm adapted to be pivotally connected to the floating structure and which is pivotally connected to said anchor cap by a first ball-and-socket joint, said arm is pivotally connected to the floating structure by a second ball-and-socket joint, the ball of said second ball-and-socket joint formed at the end of the arm and comprising a passage providing communication between an access passage connected to the anchor station enclosure and a chamber in the floating structure, said floating structure providing the socket of said second ball-and-socket joint, sealing of said access passage being provided by at least two watertight seals enclosing a film of oil between said ball and said socket, and wherein, in use, the cap is adapted to be pressed down on to the enclosure by hydrostatic pressure.

11. Connecting means as claimed in claim 10, in which said access passage is provided with an airlock, a fluid conduit in said arm and connected to said floating structure bypassing said pivotal connection by means of a flexible connection extending between said arm adjacent its end and said socket of said second ball-and-socket joint.

12. Connecting means as claimed in claim 10, in which a fluid conduit in said arm and connected to said floating structure includes a ball-and-socket joint concentric with said ball-and-socket joint connecting said arm to said anchoring station.

13. A method for interconnecting a floating structure and a submerged anchor station including an enclosure, an anchor cap adapted to be fixed to the anchor station and an arm adapted to be pivotally connected to the floating structure and which is pivotally connected to said anchor cap by a ball-and-socket joint comprising the steps of: connecting said arm to said floating structure, lowering said cap on to said anchor station while preventing movements of said cap about said ball-and-socket joint during descent of said cap and said arm only by stop means which limit tilting of said ball relative to said cap, and, evacuating water in said anchor station above said enclosure and below said cap so that said cap is pressed down on the enclosure by hydrostatic pressure.

14. A method as claimed in claim 13, in which said cap is locked in position on said anchor station, and the water in said enclosure and below said cap is evacuated.

* * * * *